US007475785B1

(12) United States Patent
Kidd

(10) Patent No.: US 7,475,785 B1
(45) Date of Patent: Jan. 13, 2009

(54) FOLDABLE DRYING RACK FOR PLASTIC BAGS

(76) Inventor: Phyllis A. Kidd, 228 Old Monticello Rd. NW., Milledgeville, GA (US) 31061

( * ) Notice: Subject to any disclaimer, the term of this patent is extended or adjusted under 35 U.S.C. 154(b) by 0 days.

(21) Appl. No.: 11/605,137

(22) Filed: Nov. 28, 2006

(51) Int. Cl.
*A47G 29/00* (2006.01)

(52) U.S. Cl. ..... 211/85.15; 211/41.6; 211/200

(58) Field of Classification Search ..... 211/12, 211/41.5, 41.6, 85.15, 21, 195, 200; 206/554; 221/26; 108/118; 248/95, 99, 100, 164, 248/431
See application file for complete search history.

(56) References Cited

U.S. PATENT DOCUMENTS

| | | | | | |
|---|---|---|---|---|---|
| 63,383 | A * | 4/1867 | Hanks | 248/97 |
| 222,542 | A * | 12/1879 | Stearns | 211/200 |
| 783,853 | A * | 2/1905 | Bernhard | 211/200 |
| 1,692,704 | A * | 11/1928 | Rohrig | 280/43.16 |
| 1,822,087 | A * | 9/1931 | Feingold | 211/198 |
| 3,374,047 | A * | 3/1968 | Gatchell | 359/727 |
| 4,221,299 | A * | 9/1980 | Taylor | 211/41.6 |
| 4,750,414 | A * | 6/1988 | Dohrs | 99/419 |
| 5,080,237 | A | 1/1992 | Hefner | |
| 5,188,244 | A | 2/1993 | Hollstegge | |
| 5,234,116 | A * | 8/1993 | Kristinsson et al. | 211/201 |
| 5,303,827 | A | 4/1994 | Ross | |
| 5,641,137 | A * | 6/1997 | Collier | 248/95 |
| 5,857,649 | A * | 1/1999 | Eason | 248/164 |
| 5,901,861 | A | 5/1999 | Huguet | |
| 6,513,674 | B1 * | 2/2003 | Kajikawa et al. | 220/572 |
| 6,640,982 | B1 | 11/2003 | Bjerke | |
| 2007/0210019 | A1 * | 9/2007 | Schnitzer | 211/41.6 |

* cited by examiner

*Primary Examiner*—Jennifer E. Novosad

(57) ABSTRACT

A rack that is easily stored and used and on which a plurality of bags can be placed for drying. The rack is X-shaped and includes a plurality of bars each of which has a pad on the distal end thereof over which a bag is placed. The X-shape of the rack makes the rack self-supporting. The bars cross each other at a central location on each bar and the intersection is flexible so the rack can be closed for storage.

1 Claim, 1 Drawing Sheet

FOLDABLE DRYING RACK FOR PLASTIC BAGS

TECHNICAL FIELD OF THE INVENTION

The present invention relates to the general art of bags, and to the particular field of reusable plastic bags.

BACKGROUND OF THE INVENTION

Plastic bags, such as kitchen freezer bags and sandwich bags, have become widely popular due to the convenience they provide and the recent improvements in the design of such bags. The use of plastic pouches for the storage of leftover food or for retaining non-food items is a common practice made even more convenient by pressure sensitive strips for sealing the mouth of the bag. The food pouches are generally referred to as freezer bags such as typically distributed under the trademarks GLAD-LOCK® and ZIPLOC®. A problem encountered when using freezer bags, especially for food storage, is that after the contents have been removed, a residue and/or food odor remains within the bag, thus making it impractical to reuse the bag for other food items. However, it has become known that widespread disposal of such bags in landfills causes harm to the environment, due in part to the extended length of time required for the bags to adequately decompose. For this reason, as well as for economic reasons, many people have been washing such bags after use, drying them, and then reusing them instead of disposing of them. It has been found difficult however, to satisfactorily drain and dry these bags especially for the reason that as a result of the relatively thin wall construction and single seam edge sealing, the walls tend to adhere and thus prevent adequate drainage and effective air drying. Makeshift solutions to this problem, such as by placing the mouth of the bag over pop bottles or soda cans, does not provide a satisfactory remedy. Therefore, a plastic bag will not, if left by itself, adequately dry.

SUMMARY OF THE INVENTION

The above-discussed disadvantages of the prior art are overcome by a rack that is easily stored and used and on which a plurality of bags can be placed for drying. The rack is X-shaped and includes a plurality of bars each of which has a pad on the distal end thereof over which a bag is placed. The X-shape of the rack makes the rack self-supporting. The bars cross each other at a central location on each bar and the intersection is flexible so the rack can be closed for storage.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 2:
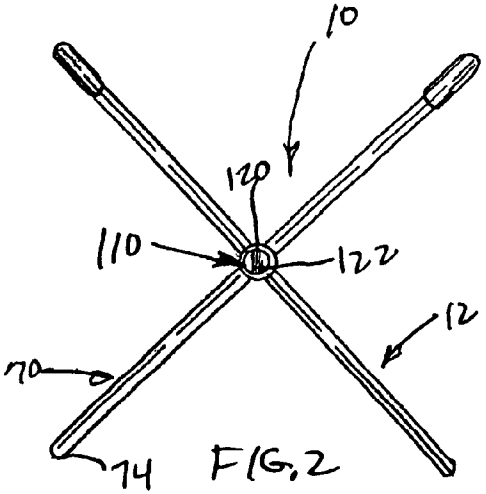
FIG. 2 is an end elevational view thereof.
Figure 3:
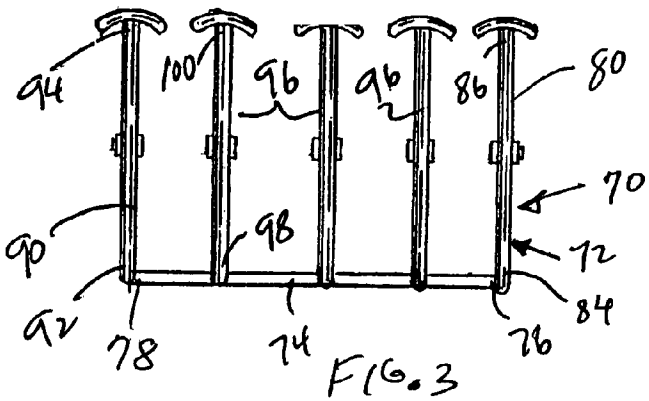
FIG. 3 is a side elevational view thereof.

Referring to the figures, it can be understood that the present invention is embodied in a bag drying rack 10 that is used to dry plastic bags, such as the bags produced under the trademark ZIPLOC®. Rack 10 comprises a first frame unit 12 which includes a U-shaped outer perimeter 14 which includes a bight section 16 which has first and second ends 18 and 20. A first leg 26 has a first end 28 which is a proximal end and which is unitary with first end 18 of the bight section and a second end 30 which is a distal end.

A second leg 40 has a first end 42 which is a proximal end and which is unitary with second end 20 of the bight section and a second end 44 which is a distal end. First frame unit 12 further includes a plurality of central legs 50. All of the central legs are identical and each central leg includes a first end 52 which is a proximal end and which is unitary with bight section 16. Each central leg further includes a second end 54 which is a distal end.

Rack 10 further includes a second frame unit 70 which is identical to the first frame unit and includes a U-shaped outer perimeter 72 which includes a bight section 74 which has a first and second ends 76 and 78. Outer perimeter 72 further includes a first leg 80 which has a first end 84 which is a proximal end and which is unitary with first end 76 of bight section 74 and a second end 86 which is a distal end. Perimeter 72 further includes a second leg 90 which has a first end 92 which is a proximal end and which is unitary with second end 78 of bight section 74 and a second end 94 which is a distal end. Unit 70 further includes a plurality of identical central legs 96. Each central leg 96 includes a first end 98 which is a proximal end and which is unitary with bight section 74 and a second end 100 which is a distal end.

Figure 1:
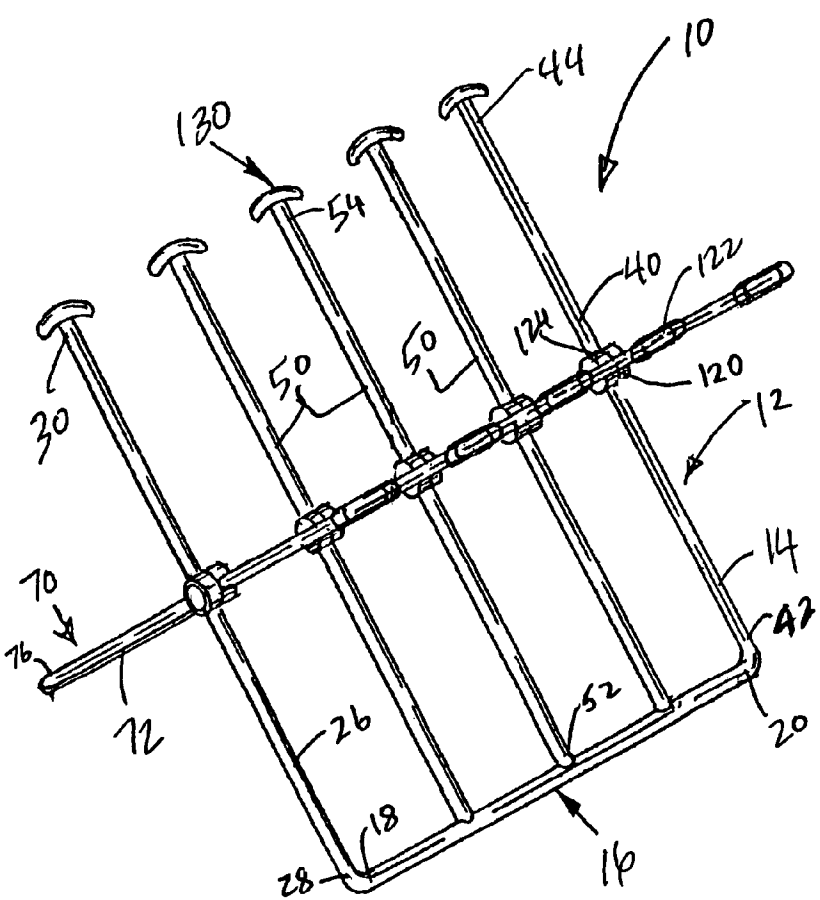
FIG. 1 is a perspective view of a bag drying rack embodying the present invention.

Rack 10 further includes a plurality of identical joint elements 110. Each joint element pivotally connects one leg of the first frame unit to a corresponding leg of the second frame unit so the legs of the frame units form X-shapes (see FIGS. 1 and 2) and can move between a first orientation relative to each other forming the X-shape and a second orientation relative to each other in which the legs extend in a common direction with each other. Each joint element includes a tubular sleeve 120 and a pivot pin 122. A leg from the first frame unit being fixedly connected to the tubular sleeve and a leg from the second frame unit being fixedly connected to the pivot pin. The sleeve of each joint element has a slot 124 defined therein through which the leg from the second frame unit extends to be connected to the pivot pin.

A pad 130 is mounted on the distal end of each leg. A bag to be dried is placed on the pad after the unit has been deployed into the open configuration shown in FIG. 1. After the bag is dried, it is removed from the pad. After use, the unit can be collapsed for storage.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A bag drying rack comprising:

A) a first frame unit which includes (1) a U-shaped outer perimeter which includes (a) a bight section having first and second ends, (b) a first leg having (i) a first end which is a proximal end and which is unitary with the first end of the bight section, and (ii) a second end which is a distal end, (b) a second leg having (i) a first end which is a proximal end and which is unitary with the second end of the bight section, and (ii) a second end which is a distal end, (c) a plurality of central legs between the first and second legs, each of which includes (i) a first end which is a proximal end and which is unitary with the bight section, and (ii) a second end which is a distal end, and (d) where distances between the first and second ends of the first leg, the second leg, and the plurality of central legs are substantially equal to each other; and B) a second frame unit which includes (1) a U-shaped outer perimeter which includes (a) a bight section having first and second ends, (b) a first leg having (i) a first end which is a proximal end and which is unitary with the first end of the bight section of the second frame unit, and (ii) a second end which is a distal end, (b) a second leg having (i) a first end which is a proximal end and which is unitary with the second end of the bight section of the second frame unit, and (ii) a second end which is a distal end, and (c) a plurality of central legs between the first and second legs, each of which includes (i) a first end which is a proximal end and which is unitary with the bight section, and (ii) a second end which is a distal end, and (d) where distances between the first and second ends of the first leg, the second leg, and the plurality of central legs are substantially equal to each other; and C) a plurality of joint elements, each joint element pivotally connecting one leg of the first frame unit to a corresponding leg of the second frame unit so the legs of the frame units form X-shapes and can move between a first orientation relative to each other forming the X-shape and a second orientation relative to each other in which the legs extend in a common direction with each other, and each of the second ends is separated from the other second ends.

* * * * *